US005968698A

United States Patent [19]

Honda

[11] Patent Number: 5,968,698

[45] Date of Patent: Oct. 19, 1999

[54] IMAGE FORMING METHOD IN AN IMAGE FORMING APPARATUS UTILIZING AN ELECTROPHOTOGRAPHIC SYSTEM

[75] Inventor: Mitsunobu Honda, Suita, Japan

[73] Assignee: Minolta Co., Ltd, Osaka, Japan

[21] Appl. No.: 08/637,257

[22] Filed: Apr. 24, 1996

[30] Foreign Application Priority Data

| | | | |
|---|---|---|---|
| Apr. 25, 1995 | [JP] | Japan | 7-125878 |
| Apr. 25, 1995 | [JP] | Japan | 7-125879 |
| Apr. 25, 1995 | [JP] | Japan | 7-125881 |
| Apr. 25, 1995 | [JP] | Japan | 7-125882 |

[51] Int. Cl.[6] ..... G03G 21/12

[52] U.S. Cl. ..... 430/106.6; 430/125; 430/126; 399/351

[58] Field of Search ..... 355/351, 299, 355/296; 15/256.5; 430/106.6, 126

[56] References Cited

U.S. PATENT DOCUMENTS

| | | | |
|---|---|---|---|
| 4,026,648 | 5/1977 | Takahashi | 355/15 |
| 4,519,698 | 5/1985 | Kohyama et al. | 355/15 |
| 4,619,523 | 10/1986 | Maeda et al. | 355/15 |
| 4,974,030 | 11/1990 | Tokunaga et al. | 355/296 |
| 5,043,769 | 8/1991 | Osawa et al. | 355/299 |
| 5,187,039 | 2/1993 | Meyer | 430/126 |
| 5,220,390 | 6/1993 | Ohtani et al. | 355/296 |
| 5,530,538 | 6/1996 | Godlove | 355/299 |

*Primary Examiner*—John Goodrow
*Attorney, Agent, or Firm*—McDermott, Will & Emery

[57] ABSTRACT

In an image forming method in which an electrostatic latent image is formed on a rotating image carrier, the electrostatic latent image is developed by toner particles, to form a toner image on the surface of the image carrier, the toner image is transferred to a recording medium, and toner particles or the like remaining on the surface of the image carrier are removed by a cleaning blade, inorganic fine particles having a BET specific surface area from 30 to 300 $m^2/g$ stay in a portion on the upstream side of a portion where the cleaning blade is in contact with the surface of the image carrier in the direction of rotation of the image carrier, and the length of the portion where the inorganic fine particles stay on the upstream side of the contact portion in the direction of rotation of the image carrier is in the range of 5 to 50 $\mu$m.

20 Claims, 5 Drawing Sheets

IMAGE FORMING METHOD IN AN IMAGE FORMING APPARATUS UTILIZING AN ELECTROPHOTOGRAPHIC SYSTEM

BACKGROUND OF THE INVENTION

1. Field of the Invention

The present invention relates generally to an image forming method in an image forming apparatus utilizing an electrophotographic system such as a copying machine, a printer, or a facsimile, and more particularly, to an image forming method in which a toner image formed on the surface of an image carrier is transferred to a recording medium, after which residues such as toner particles remaining on the surface of the image carrier can be stably cleaned by a cleaning blade composed of an elastic member.

2. Description of the Prior Art

Generally in forming images in an image forming apparatus utilizing an electrophotographic system such as a copying machine, a printer, or a facsimile, an image carrier 1 in a cylindrical shape is rotated, to charge the surface of the image carrier 1 by a charger 2, after which an electrostatic latent image is formed on the image carrier 1 by suitable exposing means (not shown), toner particles 4 in a developing agent are supplied to the electrostatic latent image on the image carrier 1 from a developing device 3, to form a toner image on the surface of the image carrier 1, the toner image is transferred to a recording medium 6 such as paper by a transferring and separating charger 5, and the recording medium 6 is separated from the image carrier 1, as shown in FIG. 1.

The recording medium 6 is introduced into a fixing roller 7, and the toner image transferred in the above-mentioned manner is fixed to the recording medium 6 by the fixing roller 7, while residues such as the toner particles 4 remaining on the surface of the image carrier 1 after the transfer are removed from the surface of the image carrier 1 by a cleaning device 8, after which a potential remaining on the image carrier 1 is discharged by a discharger (not shown).

As the cleaning device 8 for removing the residues such as the toner particles 4 remaining on the surface of the image carrier 1 after the transfer in the above-mentioned manner, various devices such as a device using a cleaning brush are employed. A device so adapted that a cleaning blade 8*a* composed of an elastic member is used, an end of the cleaning blade 8*a* is caused to abut against the surface of the image carrier 1, and the residues such as the toner particles 4 remaining on the surface of the image carrier 1 are removed by the cleaning blade 8*a*, as shown in FIG. 1, is frequently employed in that it is low in cost and is simple in construction.

On the other hand, in recent years, toner particles having small particle diameters have been used as the toner particles 4 in order to reproduce precise images in the above-mentioned image forming apparatus.

If the toner particles 4 having small particle diameters are used, however, in removing the residues such as the toner particles 4 remaining on the surface of the image carrier 1 from the surface of the image carrier 1 by the cleaning blade 8*a*, the toner particles 4 slip between the image carrier 1 and the cleaning blade 8*a*. Therefore, the toner particles 4 are liable to be insufficiently removed from the surface of the image carrier 1, whereby noise is produced in formed images.

Specifically, in a case where the toner particles 4 having small particle diameters are produced by the kneading and pulverizing method conventionally commonly used, even if the toner particles 4 having small particle diameters are classified by an air classifier or the like, fine powder included in the toner particles 4 is not sufficiently removed. When the fine powder, together with the toner particles 4, is supplied to the surface of the image carrier 1, therefore, the fine powder is not removed from the surface of the image carrier 1 by the cleaning blade 8*a*, to pass between the cleaning blade 8*a* and the image carrier 1. At the time of the passage, the fine powder adheres to the surface of the image carrier 1, whereby noise is produced in formed images.

On the other hand, in a case where the toner particles 4 having small particle diameters are produced by the wet granulating method such as the suspension polymerization method or the emulsion dispersion method, the particle diameters of the toner particles 4 thus obtained are distributed in a narrow range and are relatively uniform. The shapes of the toner particles 4 are approximately spherical. When the end of the cleaning blade 8*a* is pressed against the surface of the image carrier 1, to remove the residues such as the toner particles 4 remaining on the surface of the image carrier 1 as mentioned above, the toner particles 4 whose shapes are approximately spherical slip between the image carrier 1 and the cleaning blade 8*a*. Therefore, the toner particles 4 are not sufficiently removed from the surface of the image carrier 1, whereby noise is produced in formed images.

Furthermore, in a case where the toner particles 4 having small particle diameters are agitated with magnetic carriers, to frictionally charge the toner particles 4, the rising of the charging of the toner particles 4 is degraded if the magnetic carriers are conventionally commonly used. Therefore, magnetic carriers having small particle diameters have been used as the magnetic carriers.

When the magnetic carriers having small particle diameters are used, however, the carriers are liable to adhere to the image carrier 1. If the magnetic carriers adhering on the surface of the image carrier 1 are not sufficiently removed by the cleaning blade 8*a*, the surface of the image carrier 1 is damaged by the carriers, and the carriers are embedded in the surface of the image carrier 1, whereby noise is produced in formed images.

When binder-type carriers including magnetic powder in binder resin are used as the above-mentioned magnetic careers, the binder-type carriers are generally produced by the kneading and pulverizing method. At the time of the pulverization, therefore, the magnetic powder is liberated, and the magnetic powder thus liberated is included in the carriers. The liberated magnetic powder adheres to the surface of the image carrier 1, and is embedded in the surface of the image carrier 1 without being sufficiently removed by the cleaning blade 8*a*, whereby noise is produced in formed images.

In recent years, in order to miniaturize the above-mentioned image forming apparatus and increase the speed thereof, an image carrier having a small diameter has been used as the above-mentioned image carrier 1, and the image carrier 1 is rotated at high speed, to form images.

When the cleaning blade 8*a* is pressed against the surface of the image carrier 1 having a small diameter which is thus rotated at high speed, to remove the residues such as the toner particles 4 remaining on the surface of the image carrier 1, the cleaning capability is further degraded, whereby the toner particles 4 are often insufficiently removed from the surface of the image carrier 1. Consequently, much noise or the like is produced in formed images, so that good images are not obtained.

Furthermore, in recent years, in transferring the toner image to the recording medium 6 and then fixing the toner image on the recording medium 6 by the fixing roller 7, a small-sized fixing roller has been used as the fixing roller 7, and temperatures at the time of fixing in the fixing roller 7 have been lowered in order to miniaturize the image forming apparatus and achieve energy saving as well as shorten warm-up time.

When the toner particles 4 transferred to the recording medium 6 are thus fixed to the small-sized fixing roller 7 at low temperatures, the nip width in the fixing roller 7 is small, and the fixing is performed at low temperatures, whereby superior fixing properties at low temperatures are required for the toner particles 4. At the beginning of heating of the fixing roller 7, the fixing roller 7 may, in some cases, be temporarily heated to high temperatures of 200° C. or more. Therefore, superior offset resistance to high temperatures is also required for the toner particles 4, and offset resistance in a low-temperature region and a high-temperature region is required.

In the toner particles 4 fixed at low temperatures as mentioned above, therefore, an anti-offset material for preventing offset in the low-temperature region and an anti-offset material for preventing offset in the high temperature region are contained.

Each of the anti-offset materials included in the toner particles 4 does not generally have compatibility with the binder resin used for the toner particles 4, and exists in a state where it is dispersed in a particle shape in the binder resin.

When the toner particles 4 containing each of the anti-offset materials are produced, therefore, the anti-offset material may, in some cases, exist as liberated fine powder in the toner particles 4. For example, when the toner particles 4 are produced by the kneading and pulverizing method conventionally commonly used, each of the anti-offset materials exists as liberated fine powder in the toner particles 4. When the toner particles 4 having small particle diameters are used in order to form precise images as mentioned above, the fine powder of the anti-offset material cannot be sufficiently removed by classification, for example, whereby much fine powder of the anti-offset material exists in the toner particles 4.

In a case where development is performed using the toner particles 4 in which the fine powder of the anti-offset material exists, when the fine powder of the anti-offset material, together with the toner particles 4, is supplied to the image carrier 1, the fine powder of the anti-offset material is not sufficiently removed from the surface of the image carrier 1 by the cleaning blade 8*a* to pass through the cleaning blade 8*a*. At the time of the passage, the fine powder of the anti-offset material is film-formed on the surface of the image carrier 1, whereby the chargeability of the image carrier 1 in this portion is degraded. Consequently, noise is produced in formed images.

SUMMARY OF THE INVENTION

A first object of the present invention is to reliably remove, in causing an end of a cleaning blade composed of an elastic member to abut against the surface of an image carrier after transfer, to remove residues such as toner particles remaining on the surface of the image carrier after the transfer by the cleaning blade in an image forming apparatus utilizing an electrophotographic system, the residues such as the toner particles on the surface of the image carrier by the cleaning blade so that good images in which there is no noise or fog are stably obtained even when toner particles having small particle diameters are used as the toner particles.

A second object of the present invention is to reliably remove, even when in a case where fine powder of an anti-offset material or the like is added in the above-mentioned toner particles having small particle diameters, the anti-offset material adheres to the surface of an image carrier, the fine powder of the anti-offset material or the like from the surface of the image carrier by a cleaning blade.

A third object of the present invention is to reliably remove, even when in a case where the above-mentioned toner particles having small particle diameters and magnetic carriers having small particle diameters are mixed and agitated to frictionally charge the toner particles, fine powder or the like included in the toner particles and the magnetic carriers adheres to the surface of an image carrier, the fine powder or the like from the surface of the image carrier.

A fourth object of the present invention is to reliably remove, even when in using an image carrier having a small diameter and forming images by rotating the image carrier at high speed, toner particles having small particle diameters are used, residues such as the toner particles on the surface of the image carrier from the surface of the image carrier by a cleaning blade.

In the present invention, in an image forming method in which an electrostatic latent image is formed on a rotating image carrier, and the electrostatic latent image is developed by toner particles, to form a toner image on the surface of the image carrier, the toner image is transferred to a recording medium, and the toner particles or the like remaining on the surface of the image carrier are removed by a cleaning blade, inorganic fine particles having a BET specific surface area from 30 to 300 $m^2/g$ stay in a portion on the upstream side of a portion where the cleaning blade is in contact with the surface of the image carrier in the direction of rotation of the image carrier, and the length of the portion where the inorganic fine particles stay on the upstream side of the contact portion in the direction of rotation of the image carrier is in the range of 5 to 50 $\mu$m.

The reason why the inorganic fine particles are stayed in the range of 5 to 50 $\mu$m in the portion on the upstream side of the portion where the cleaning blade is in contact with the surface of the image carrier in the direction of rotation of the image carrier is that the residues such as the toner particles remaining on the surface of the image carrier, particularly fine powder, a liberated anti-offset material, or the like included in the toner particles cannot be sufficiently removed if the length of the portion where the inorganic fine particles stay is less than 5 $\mu$m, while the amount of the inorganic fine particles slipping between the cleaning blade and the image carrier is decreased, lubricity between the cleaning blade and the image carrier is degraded so that the cleaning blade and the image carrier immediately wear, and the cleaning blade vibrates or is turned up due to friction with the image carrier if the length of the portion where the inorganic fine particles stay is not less than 50 $\mu$m. More preferably, such adjustment is made that the length of the portion where the inorganic fine particles stay is in the range of 15 to 30 $\mu$m.

When the inorganic fine particles having a BET specific surface area from 30 to 300 $m^2/g$ are stayed in the portion on the upstream side of the portion where the cleaning blade is in contact with the surface of the image carrier in the direction of rotation of the image carrier, the toner particles having small particle diameters remaining on the surface of the image carrier after the transfer and various types of fine powder included in the toner particles and the magnetic carriers and adhering on the surface of the image carrier are satisfactorily removed from the surface of the image carrier.

As a result, in a case where precise images are obtained using the toner particles having small particle diameters and the magnetic carriers having small particle diameters, good images in which no noise, fog or the like is produced are stably obtained.

Even in a case where the image carrier having a small diameter is used, the image carrier is rotated at high speed to form images, the toner particles or the like having small particle diameters remaining on the surface of the image carrier after the transfer are satisfactorily removed from the surface of the image carrier, so that good images in which no noise, fog or the like is produced are stably obtained.

When the inorganic fine particles having a BET specific surface area from 30 to 300 $m^2/g$ are stayed in the range of 5 to 50 $\mu$m from the portion where the cleaning blade is in contact with the surface of the image carrier as mentioned above, the proper amount of inorganic fine particles slip between the cleaning blade and the image carrier. Consequently, lubricity between the cleaning blade and the surface of the image carrier is improved, whereby wear of the cleaning blade and the image carrier is decreased. Further, the cleaning blade does not vibrate to produce sound or is not greatly deformed and turned up due to friction with the image carrier, whereby the toner particles can be sufficiently removed from the surface of the image carrier.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
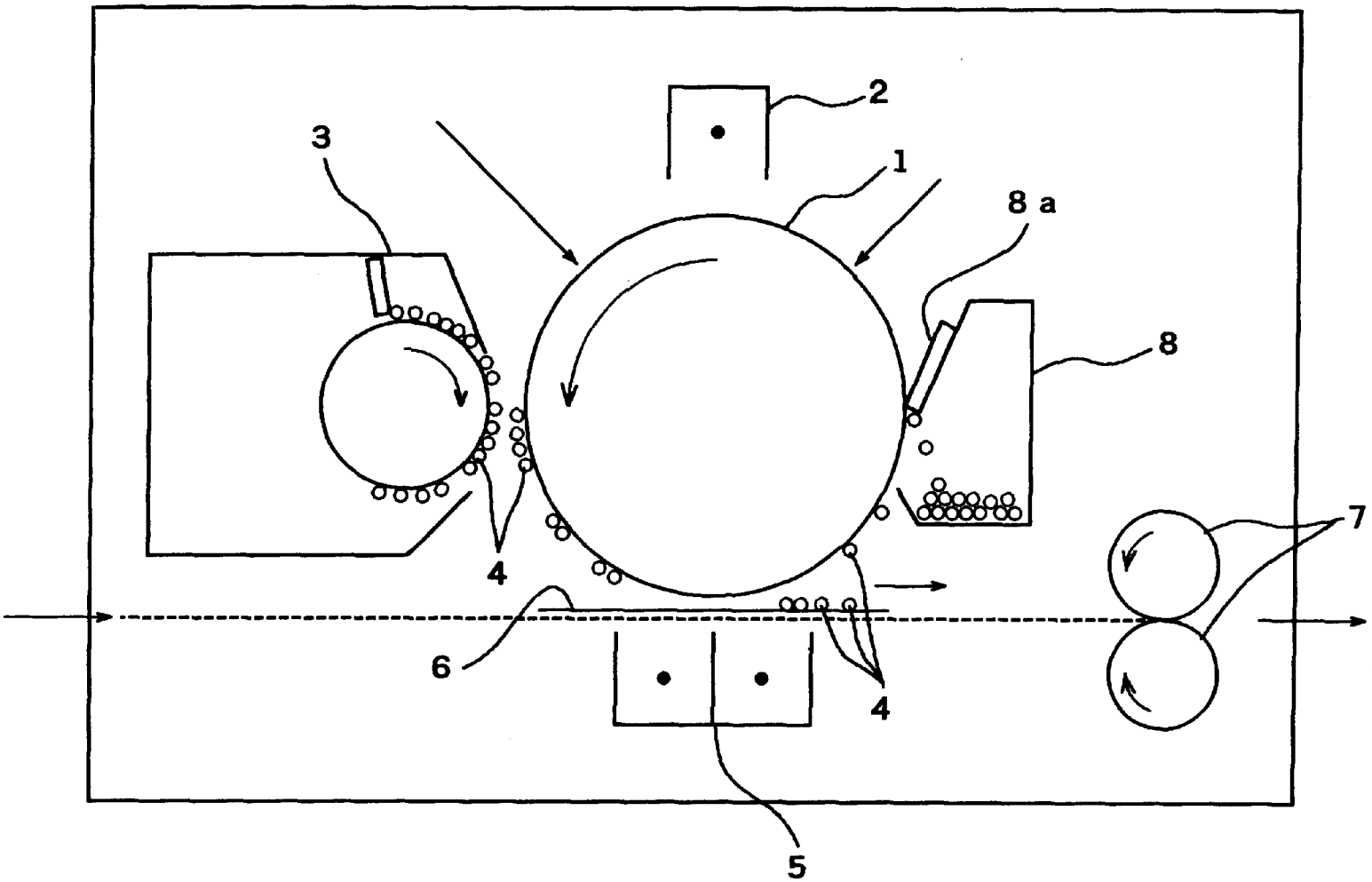
FIG. 1 is a schematic illustration showing a state where images are formed by an image forming apparatus utilizing an electrophotographic system.

Description is now made of preferred embodiments of an image forming method according to the present invention.

In the image forming method, in order to miniaturize an image forming apparatus and form images at high speed, an image carrier having a diameter of 20 to 40 mm is used. In rotating the image carrier to form images, it is preferable that the moving speed in the tangential direction of the image carrier is 200 to 500 mm/sec. However, the size and the moving speed of the image carrier are not particularly limited to the foregoing.

It is possible to use, as the image carrier, a known image carrier conventionally commonly used, for example, an image carrier in which a photosensitive layer is provided on the surface of a conductive supporting member formed in a cylindrical shape. The photosensitive layer may be composed of any inorganic or organic photosensitive material. The photosensitive layer may be of a single layer type comprising one layer or a laminated type in which a charge-generating layer and a charge-transporting layer are laminated. Further, the photosensitive layer may be provided with an undercoat layer or a surface protective layer.

In order to enhance the durability of the image carrier, it is preferable that amorphous silicon is used for the photosensitive layer, the thickness of the photosensitive layer is increased if the photosensitive layer is an organic photosensitive layer, or the surface protective layer is formed on the photosensitive layer. In increasing the thickness of the organic photosensitive layer, it is preferable that the thickness of the photosensitive layer is 30 to 60 $\mu$m when the photosensitive layer is of the single layer type, while the thickness of the charge-transporting layer is 27 to 60 $\mu$m when the photosensitive layer is of the laminated type.

When the image carrier having a small diameter is rotated at high speed as mentioned above, the cycle period is decreased. Therefore, it is preferable that the charge mobility in the photosensitive layer is set to not less than $5\times10^{-6}$ $cm^2/V\cdot sec$ under the conditions of $2\times10^5$ V/cm.

In the image forming method, it is preferable that toner particles having small particle diameters are used as toner particles for developing an electrostatic latent image formed on the image carrier in order to obtain precise images. Toner particles having a volume-mean particle size from 3 to 9 $\mu$m and preferably, having a volume-mean particle size from 5 to 8 $\mu$m are used.

In producing such toner particles, the toner particles can be produced by a known method conventionally commonly used. For example, it is possible to use the kneading and pulverizing method and various wet granulating methods in which various additives such as a colorant are added to binder resin, a mixture obtained is melted and kneaded, and the kneaded mixture is cooled, after which the cooled mixture is pulverized to form toner particles, and the formed toner particles are classified.

In obtaining the toner particles having the above-mentioned volume-mean particle size by the above-mentioned kneading and pulverizing method, it is preferable to use a rotor type classifier. The reason for this is that if the toner particles are classified using the rotor type classifier, the surfaces of the toner particles are smoothed by the function of an impact force of a classifying rotor, and fine powder causing fog and the like, fine powder having a particle diameter which is generally not more than one-third or not more than one-fourth the particle diameters of the toner particles are embedded with it strongly adhering to the surfaces of the toner particles, so that the production of liberated fine powder is decreased, and classification efficiency is improved due to the dispersion effect produced by the impact force of the classifying rotor.

Examples of such a rotor type classifier include Turbo-Classifier (manufactured by Nisshin Engineering K.K.), and Acucut (manufactured by Nippon Donaldson K.K.). Teeplex Ultrafine Powder Classifier 50–1000 ATP Series (manufactured by Hosokawa Mikuron K.K.) is preferably used.

Figure 2:
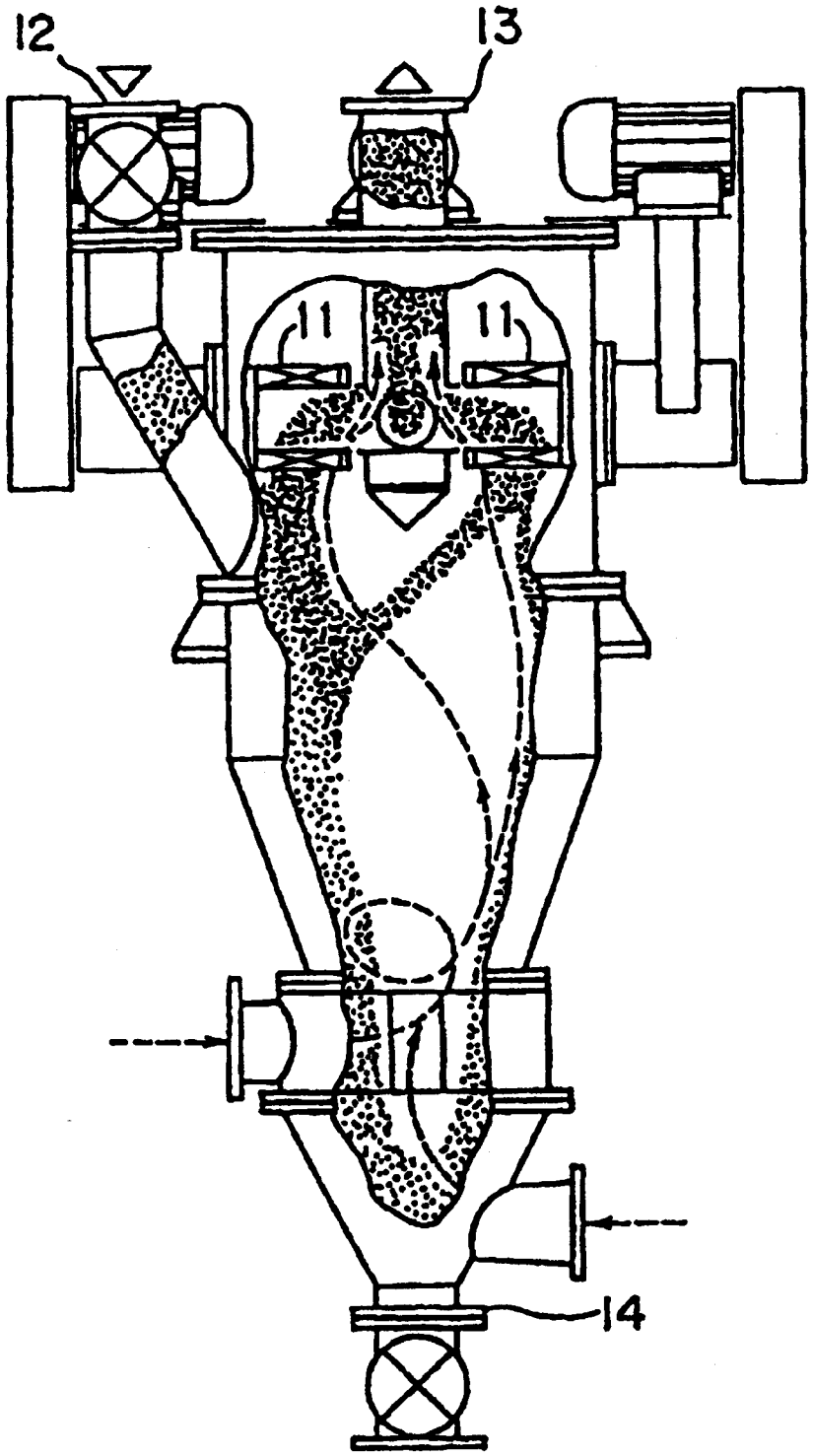
FIG. 2 is a vertical sectional view showing one example of a classifier for classifying, in a case where toner particles are pulverized in production, the pulverized toner particles.
Figure 3:
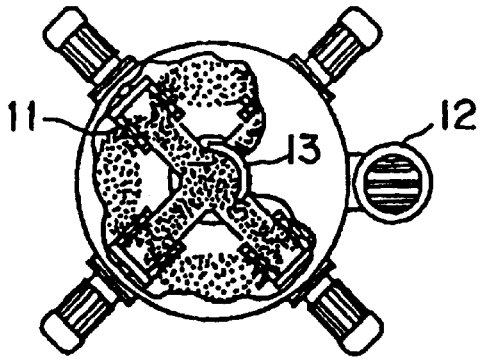
FIG. 3 is a horizontal sectional view showing a classifying portion in the classifier shown in FIG. 2.

Description is now made of Teeplex Multiwheel Type Classifier on the basis of FIGS. 2 and 3. The toner particles obtained after pulverizing the kneaded mixture as mentioned above is fed from a raw material inlet port 12, and is introduced into a classifying chamber through a rotary bulb or the like. In the classifying chamber, air is caused to flow upward from below as indicated by an arrow, and the toner particles fed as mentioned above are raised in accordance with the flow and are introduced into a classifying portion 11. In the classifying portion 11, the toner particles are classified, and fine powder included in the toner particles is taken out from a common fine powder discharge port 13, while the toner particles from which the fine powder is removed are taken out from a discharge port 14. In the classifying portion 11, a plurality of classifying rotors using a separate driving system are horizontally attached so that common speed control is carried out by one frequency converter. As the toner particles fed from the raw material inlet port 12, toner particles previously air-classified may be used.

On the other hand, in producing the toner particles by the wet granulating method, it is possible to use the granulating method including polymerization processes such as the suspension polymerization method and the emulsion polymerization method, and the granulating method such as the emulsion dispersion method which have been conventionally used.

In producing the toner particles by the suspension polymerization method, a polymerizable composition to which a polymerizable monomer to be a component of binder resin, a polymerization initiator, a colorant, and other additives as required are added is suspended in a non-solvent type medium, and the polymerizable monomer is polymerized in this state, to form toner particles.

In producing the toner particles by the emulsion polymerization method, only significantly fine particles are obtained by the general emulsion polymerization method. Therefore, it is preferable to use a method known as the seed polymerization method. A part of a polymerizable monomer and a polymerization initiator are added in a water type medium or a water type medium to which an emulsifying agent is added, and a mixture obtained is agitated to emulsify the polymerizable monomer, after which the remainder of the polymerizable monomer is gradually dropped to obtain fine particles, and the polymerizable monomer is polymerized in a droplet of the polymerizable monomer including a colorant and other additives utilizing the particles as a seed, to form toner particles.

The granulating method including polymerization processes is not limited to the foregoing. The above-mentioned toner particles can be also produced by the methods such as the soap-free emulsion polymerization method, the microcapsule method (e.g., the interfacial polymerization method or the in-situ polymerization method), and the non-aqueous dispersion polymerization method.

In producing the toner particles by the emulsion dispersion method, a colorant and other additives as required are mixed with a component of binder resin, and a mixture obtained is melted in a solvent so that its solution is suspended in a non-solvent type medium, to form toner particles.

It is possible to use, as the binder resin used for the toner particles, known binder resin conventionally commonly used. Examples of the binder resin include thermoplastic resin and thermosetting resin such as styrene series resin, acrylic series resin, methacrylic series resin, styrene-acrylic series copolymer resin, styrene-butadiene series copolymer resin, polyester series resin, and epoxy series resin. These types of resin can be also used separately or in combination. If the softening point of the binder resin used for the toner particles is higher than 140° C., a problem arises in fixing properties at low temperatures. On the other hand, if the softening point is lower than 80° C., a problem arises in offset properties, heat resistance, and storage stability. Therefore, as the above-mentioned binder resin, binder resin having a softening point from 80 to 140° C. and preferably, from 90 to 130° C. is used. The softening point is a value measured by a differential scanning calorimeter (DSC). When the toner particles are used for developing a full-color image, it is preferable that polyester resin is used as the binder resin from the point of improvement of light transmittance.

It is possible to use, as the colorant contained in the toner particles, various known pigments and dyes conventionally commonly used. Examples of available black pigments include carbon black, cupric oxide, manganese dioxide, aniline black, activated carbon, ferrite, and magnetite. Examples of available yellow pigments include chrome yellow, zinc yellow, cadmium yellow, yellow oxide, mineral fast yellow, nickel titanium yellow, nables yellow, naphthol yellow S, hansa yellow G, hansa yellow 10G, benzidine yellow G, benzidine GR, quinoline yellow lake, permanent yellow NCG, and tartrazine lake. Examples of available red pigments include chrome orange, molybdenum orange, permanent orange GTR, pyrazolone orange, vulcan orange, indanthrene brilliant orange RK, benzidine orange G, indanthrene brilliant orange GK, red iron oxide, cadmium red, red lead oxide, permanent red 4R, lithol red, pyrazolone red, watchung red, lake red C, lake red D, brilliant carmine 6B, eosine lake, rhodamine lake B, alizarin lake; brilliant carmine 3B, vulcan fast orange GG, permanent red F4RH, and permanent carmine FB. Examples of available blue pigments include prussian blue, cobalt blue, alkali blue lake, victoria blue lake, and phtalocyanine blue. In containing the colorant in the toner particles, the content of the colorant is 1 to 20 parts by weight and preferably, 3 to 15 parts by weight per 100 parts by weight of the binder resin in order to sufficiently color the toner particles as well as prevent the chargeability of the toner particles, for example, from being unstabilized.

In the image forming method, when the toner image transferred to the recording medium is fixed at low temperatures by a small-sized fixing roller, it is preferable that an anti-offset material A for preventing offset in a low-temperature region and an anti-offset material B for preventing offset in a high-temperature region are added to the toner particles, to prevent offset in the low-temperature region and the high-temperature region.

As the above-mentioned anti-offset material A, an anti-offset material having a softening point lower than the softening point of the above-mentioned binder resin, that is, from 60 to 110° C. and preferably, from 80 to 100° C. is used. Examples of such an available anti-offset material A include carnauba wax, sasol wax, rice wax, candelila wax, jojoba oil wax, beeswax, polyethylene wax having acid groups, and polyethylene wax.

On the other hand, as the above-mentioned anti-offset material B, an anti-offset material having a softening point which is the same as and preferably, higher by not less than 10° C. than the softening point of the above-mentioned binder resin, that is, from 110 to 150° C. and preferably, from 130 to 150° C. is used. Examples of such an available anti-offset material B include polyethylene wax, polypropylene wax, polyethylene wax having acid groups, and polypropylene wax having acid groups.

When each of the anti-offset materials A and B is contained in the toner particles, the content of the anti-offset material A is 1 to 6 parts by weight and preferably, 2 to 5 parts by weight per 100 parts by weight of the binder resin, the content of the anti-offset material B is 0.5 to 5 parts by weight and preferably, 1 to 3 parts by weight of the anti-offset material B per 100 parts by weight of the binder resin, and the total amount of both the anti-offset materials A and B is 2 to 7 parts by weight and preferably, 3 to 5 parts by weight per 100 parts by weight of the binder region in order to respectively obtain sufficient anti-offset effects in the low-temperature region and the high-temperature region as well as prevent the flowability of the toner particles from being degraded by adding each of the anti-offset materials A and B.

As the above-mentioned fixing roller for fixing the toner particles to the recording medium at low temperatures, a small-sized fixing roller having a diameter of not more than 25 mm and preferably, approximately 10 to 20 mm is used. It is preferable that spring pressure applied between fixing rollers is set to approximately 3.0 to 6.0 kg in order to sufficiently fix the toner particles to the recording medium as well as prevent the fixing roller from being clogged with the recording medium.

In the above-mentioned toner particles, a desired additive such as a charge-controlling agent can be added in the binder resin in addition to the above-mentioned colorant and anti-offset material.

In a case where the charge-controlling agent is added to the toner particles, examples of an available positive charge-controlling agent for positively charging the toner particles include a nigrosine dye, quaternary ammonium salt, a polyamine compound, and an imidazole compound. In addition, examples of an available negative charge-controlling agent for negatively charging the toner particles include a calixarene compound, an azo dye of chromium complex type, a copper phthalocyanine dye, chromium complex salt, zinc complex salt, and aluminum complex salt. In containing the charge-controlling agent in the toner particles, the content of the charge-controlling agent is generally 0.1 to 10 parts by weight and preferably, 0.5 to 5 parts by weight per 100 parts by weight of the binder resin in order to suitably charge the toner particles.

In order to apply magnetism to the toner particles to use the toner particles as magnetic toner particles, metals exhibiting magnetism such as iron, nickel and cobalt, alloys of the metals and zinc, antimony, aluminum, lead, tin, beryllium, bismuth, manganese, selenium, titanium, tungsten, vanadium, and the like or their mixtures as well as magnetic materials such as magnetize, γ-hematite, and various types of ferrite may be added in the above-mentioned binder resin.

Furthermore, in a case where a two-component developing agent having magnetic carriers added to toner particles is used, it is possible to use known magnetic carriers conventionally commonly used. Examples of the magnetic carriers include carriers composed of particles of a magnetic material such as iron or ferrite, resin-coated carriers obtained by coating particles of such a magnetic material with resin, and binder type carriers obtained by dispersing fine powder of the magnetic material in binder resin.

In order to completely charge the toner particles using such magnetic carriers as well as obtain precise images, while preventing the magnetic carriers from adhering to the image carrier, magnetic carriers having a volume-mean particle size from 10 to 80 μm and preferably, from 10 to 40 μm and more preferably, from 15 to 30 μm are used.

In order to prevent the magnetic carriers from being degraded by the toner particles to enhance the durability of the magnetic carriers, it is preferable to use resin-coated carriers using as coating resin silicone series resin, copolymer resin (graft resin) of organopolysiloxane and a vinyl series monomer, and fluorine series plastic, and binder type carriers using as binding resin polyester series resin and polyolefin series resin.

In obtaining the above-mentioned binder type carriers, examples of available binder resin include polystyrene series resin, poly (meta) acrylic series resin, styrene-acrylic copolymer series resin, polyolefin series resin, polyester series resin, and epoxy series resin.

Examples of available magnetic powder contained in the binder resin include magnetic metals such as iron, nickel and cobalt, alloys of the magnetic metals and metals such as zinc, antimony, aluminum, lead, tin, bismuth, beryllium, manganese, selenium, tungsten, zirconium and vanadium or their mixtures as well as mixtures of the magnetic metals and metallic oxides such as titanium oxide and magnesium oxide, ferromagnetic ferrite, and magnetite.

In order to uniformly disperse the magnetic powder in the binder resin, magnetic powder having a primary particle diameter of 5 μm or less and preferably, 2 μm or less and more preferably, from 0.1 to 1 μm is used.

As the ratio of the above-mentioned magnetic powder to the binder resin, the content of the magnetic powder is generally 100 to 900 parts by weight and preferably, 200 to 600 parts by weight per 100 parts by weight of the binder resin because the magnetic powder is changed into secondary particles so that it is not uniformly dispersed in the binder resin and obtained carriers become fragile if the content of the magnetic powder is too large, while sufficient magnetism is not obtained if the content of the magnetic powder is too small.

In order to uniformly disperse the magnetic powder in the binder resin in the binder type carriers, it is preferable to contain a dispersant such as carbon black, silica, titania, and alumina. It is preferable that the content of the dispersant is in the range of 0.01 to 3% by weight of the carrier.

In order to obtain binder type carriers having superior durability in which magnetic powder is not separated, for example, even when the carriers are repeatedly used, it is preferable that the carriers are subjected to heat treatment to improve the quality of the surface state of the carriers. As such heat treatment, it is preferable that the carriers are injected into an air current to instantaneously heat the carriers. Examples of an available heat treatment equipment include Surfusing System (manufactured by Nippon Pnewmatic Kogyo K.K.). It is preferable that the heating temperature is approximately 150 to 350° C.

On the other hand, it is possible to use, as a cleaning blade for removing the residues such as the toner particles remaining on the surface of the image carrier after transfer, a cleaning blade composed of a known elastic material conventionally commonly used. Examples of an available cleaning blade include a cleaning blade composed of polyurethane rubber, silicone rubber, or the like.

In causing the cleaning blade to abut against the surface of the image carrier to remove the residues such as the toner particles remaining on the surface of the image carrier, it is possible to use, as inorganic fine particles having a BET specific surface area from 30 to 300 $m^2/g$ which are stayed in a portion on the upstream side of a portion where the cleaning blade is in contact with the surface of the image carrier in the direction of rotation of the image carrier, silica fine particles, titanium oxide fine particles, alumina fine particles, magnesium fluoride fine particles, silicon carbide fine particles, boron carbide fine particles, titanium carbide fine particles, zirconium carbide fine particles, boron nitride fine particles, titanium nitride fine particles, zirconium nitride fine particles, magnetite fine particles, molybdenum disulfide fine particles, aluminum stearate fine particles, magnesium stearate fine particles, zinc stearate fine particles, and the like. Further, it is preferable to make the inorganic fine particles hydrophobic using a silan coupling agent, a titanium coupling agent, higher fatty acid, silicon oil, or the like in order to improve stability to a environment change such as a humidity change in the inorganic fine particles.

It is possible to add the inorganic fine particles to the above-mentioned toner particles to adhere on the surfaces of the toner particles, supply the inorganic fine particles, together with the toner particles, to the image carrier, and stay the inorganic fine particles in a staying portion formed between the cleaning blade and the surface of the image carrier.

When inorganic fine particles having a BET specific surface area from 30 to 300 $m^2/g$ are added to the toner particles to adhere on the surfaces of the toner particles, the fluidity and the chargeability of the toner particles are improved. When the inorganic fine particles are thus added to the toner particles to adhere on the surfaces of the toner particles, 0.05 to 3.0% by weight and preferably, 0.1 to 1.0% by weight of the inorganic fine particles are added to the toner particles in order to apply sufficient fluidity to the toner particles as well as enhance the cleaning function and the lubricating function.

As the above-mentioned inorganic fine particles, two types of inorganic fine particles, that is, inorganic fine particles which are easily stayed in a staying portion and inorganic fine particles which enhance lubricity of the cleaning blade and the surface of the image carrier may be used in combination. Examples of the inorganic fine particles which are easily stayed in the staying portion include inorganic fine particles having a BET specific surface area from 30 to 80 $m^2/g$ and preferably, from 30 to 60 $m^2/g$. On the other hand, examples of the inorganic fine particles which enhance lubricity include inorganic fine particles having a BET specific surface area from 80 to 300 $m^2/g$ and preferably, from 100 to 300 $m^2/g$.

In order to improve the cleaning capability or the like, various fine particles of resin such as styrene series resin, acrylic series resin, methacrylate series resin, benzoguanamine, silicone, Teflon, polyethylene, and polypropylene may be added in addition to the above-mentioned inorganic fine particles to the toner particles.

In the image forming method, in order to remove the residues such as the toner particles remaining on the surface of the image carrier more effectively in staying the inorganic fine particles in a portion on the upstream side of a portion where the cleaning blade is in contact with the surface of the image carrier in the direction of rotation of the image carrier to remove the residues such as the toner particles remaining on the surface of the image carrier, the inorganic fine particles are stayed as mentioned above, and the toner particles or the like are stayed in the portion on the upstream side of the portion where the inorganic fine particles stay in the direction of rotation of the image carrier so that the length of a portion where the inorganic fine particles and the toner particles or the like stay and stand still is from 10 to 100 $\mu$m and preferably, from 30 to 80 $\mu$m.

The length of the portion where the inorganic fine particles and the toner particles or the like stay changes depending on the material of the cleaning blade, the angle at which the cleaning blade abuts against the image carrier, the surface properties of the image carrier, the moving speed of the image carrier, the properties of the toner particles and the inorganic fine particles used, and the like, whereby they are so suitably adjusted that the length of the portion where the inorganic fine particles and the toner particles or the like stay is in the above-mentioned range.

Figure 4:
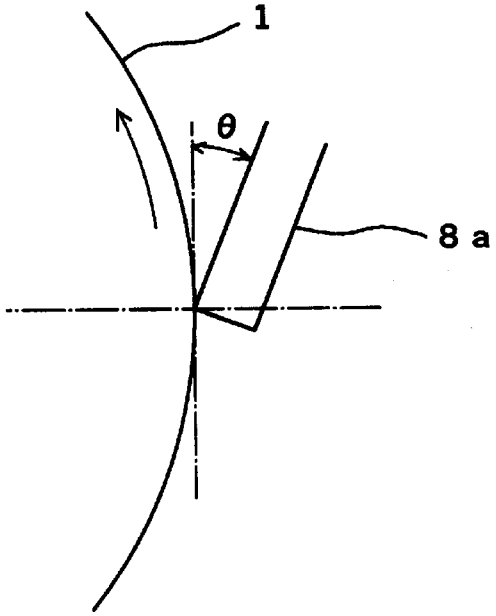
FIG. 4 is a partial illustration showing a state where a cleaning blade is caused to abut against the surface of an image carrier.

When the length of the portion where the inorganic fine particles and the toner particles or the like stay is increased, a cleaning blade having a low rubber hardness and having a large thickness is generally used as the cleaning blade, and a contact angle θ of the cleaning blade 8*a* with the image carrier 1 is increased and contact pressure thereof is increased in pressing the end of the cleaning blade 8*a* against the surface of the image carrier 1, as shown in FIG. 4. As the image carrier, an image carrier having a rough surface finish and having a high coefficient of friction is used. As the inorganic fine particles, inorganic fine particles having a small BET specific surface area and being low in fluidity are used. The amount of the inorganic fine particles added to the toner particles is increased. In addition, as the toner particles, toner particles having large particle diameters, having a shape greatly deformed from a sphere and being low in charging amount and fluidity are used. On the other hand, when the length of the portion where the inorganic fine particles and the toner particles or the like stay is decreased, processing contrary to the foregoing processing is performed.

The fact that the residues such as the toner particles remaining on the surface of the image carrier after the transfer are reliably removed by the cleaning blade to satisfactorily form images in the image forming method according to the present invention will be specifically described on the basis of the following examples of experiments.

EXAMPLE 1

In this example, in obtaining toner particles used for a developing agent, low-molecular weight polyester resin and polyester resin to be made high-molecular which are produced in the following manner are used as binder resin in the toner particles.

In obtaining the low-molecular weight polyester resin, a 5 liter four neck flask on which a reflux condenser, a water separator, a nitrogen gas inlet tube, and an agitator are mounted was located in a mantle heater. 1376 g of a bisphenol polypropylene oxide additive, 659 g of isophthalic acid, and 90 g of diethylene glycol were added in the four neck flask, followed by dehydrogenation condensation at temperatures from 220 to 270° C. while introducing nitrogen gas into the flask, to obtain low-molecular weight polyester resin.

On the other hand, in obtaining polyester resin to be made high-molecular, a four neck flask was similarly located in the mantle heater. 1720 g of a bisphenol propylene oxide additive, 1028 g of isophthalic acid, 328 g of 1, 6-dipropyl-1,6 -hexane diol, and 74.6 g of glycerine were added in the four neck flask, followed by dehydrogenation condensation at a temperature of 240° C. while introducing nitrogen gas into the flask, to obtain polyester resin to be made high-molecular.

80 parts by weight of the low-molecular weight polyester resin and 20 parts by weight of the polyester resin to be made high-molecular obtained in the above-mentioned manner were put into Henschel Mixer, and they were sufficiently uniformly agitated.

Thereafter, 40 parts by weight of diphenylmethane-4, 4-diisocyanate was added to a mixture obtained, and they were reacted with each other for one hour at a temperature of 120° C. by a heating kneader, to confirm by measuring NCO % that there are few liberated isocyanate groups left, to produce polyester resin modified by urethane. The polyester resin modified by urethane is used as binder resin in the toner particles. The glass transition point, the softening point, and the acid value of the polyester resin modified by urethane thus obtained are respectively 63.5° C., 11.5° C., and 26.

100 parts by weight of the polyester resin modified by urethane, 5 parts by weight of carbon black (Mogal L made by Cabot K.K.), 2 parts by weight of a charge-controlling agent (S-34 made by Orient Kagaku Kogyo K.K.), 1.5 parts by weight of a low-temperature anti-offset material having a softening point of 85° C. and having an acid value of 4 (Carnauba wax made by Kato Yoko K.K.), and 1.0 part by weight of a high-temperature anti-offset material (Biscole TS-200A made by Sanyo Kasei K.K.) were mixed and dispersed using Henschel Mixer. Thereafter, a mixture obtained was kneaded using a biaxial extruder, and the kneaded mixture was cooled, after which the cooled mixture was granulated, and was further pulverized using a jet mill pulverizer, followed by classification using a rotary vane type classifier (100/4ATP manufactured by Hosokawa Mikuron K.K.), to obtain spherical toner particles having a volume-mean particle size of 8.6 $\mu$m.

0.5% by weight of hydrophobic silica having a BET specific surface area of 140 $m^2/g$ (H2000 made by Hoechst Japan Ltd.) was added as inorganic fine particles to the toner particles thus obtained, and they were mixed using Henschel Mixer, to make the hydrophobic silica adhere to the surfaces of the toner particles.

Figure 5:
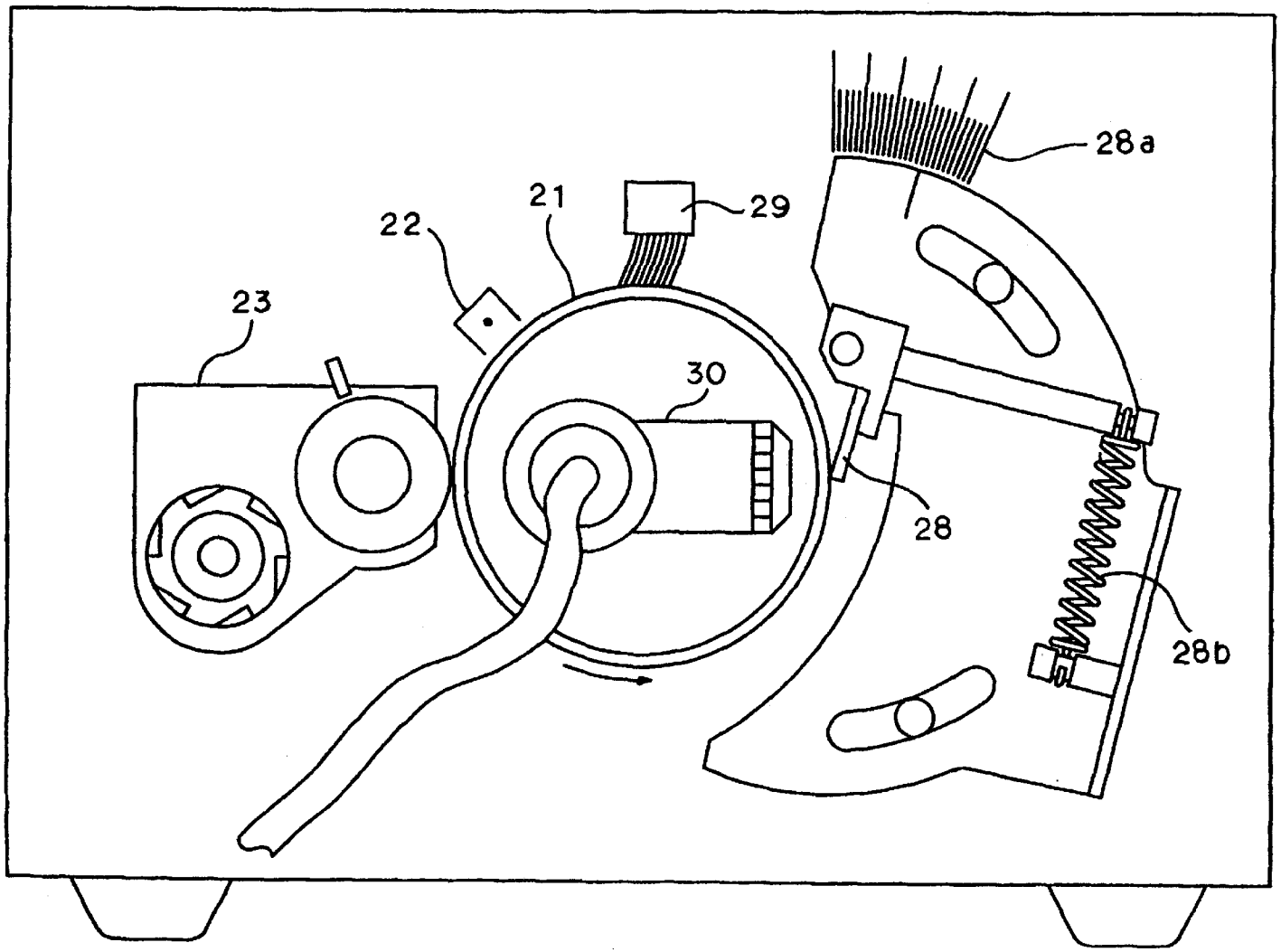
FIG. 5 is a schematic view showing an experiment device used for examining a state where toner particles or the like on the surface of an image carrier are removed by a cleaning blade in an example of experiments.

The toner particles on which the hydrophobic silica adheres as mentioned above are supplied to a developing device 23 in an experiment device 20 shown in FIG. 5, to conduct experiments.

In the experiment device 20, an image carrier for examination 21 in which a transparent charge-transporting layer is provided on the surface of a transparent glass tube formed in a cylindrical shape is used, and the image carrier for examination 21 is rotated, to charge the surface of the image carrier 21 by a charger 22, after which the above-mentioned toner particles are supplied to the surface of the image carrier 21 from a developing device 23, and an end of the cleaning blade 28 is caused to abut against the surface of the image carrier 21 to which the toner particles are thus supplied, to remove the toner particles on the surface of the image carrier 21 by the cleaning blade 28, after which a potential remaining on the image carrier 21 is discharged by a discharger 29.

Examples of the above-mentioned cleaning blade 28 include a cleaning blade composed of polyurethane rubber having a rubber hardness of 67°, having a Young's modulus of 55 $kg/cm^2$ and having impact resilience of 52% (made by Hokushin Rubber K.K.). In pressing the cleaning blade 28 against the image carrier 21, a contact angle θ is adjusted while being measured by an angle measuring device 28*a*, and contact pressure for pressing the end of the cleaning blade 28 against the surface of the image carrier 21 is adjusted by a spring 28*b*.

A state where the toner particles or the like on the surface of the image carrier 21 are removed by the cleaning blade 28 is photographed by a CCD camera 30 provided on the side of the inner periphery of the image carrier 21, to examine how the residues such as the toner particles are removed from the surface of the image carrier 21.

Figure 6:
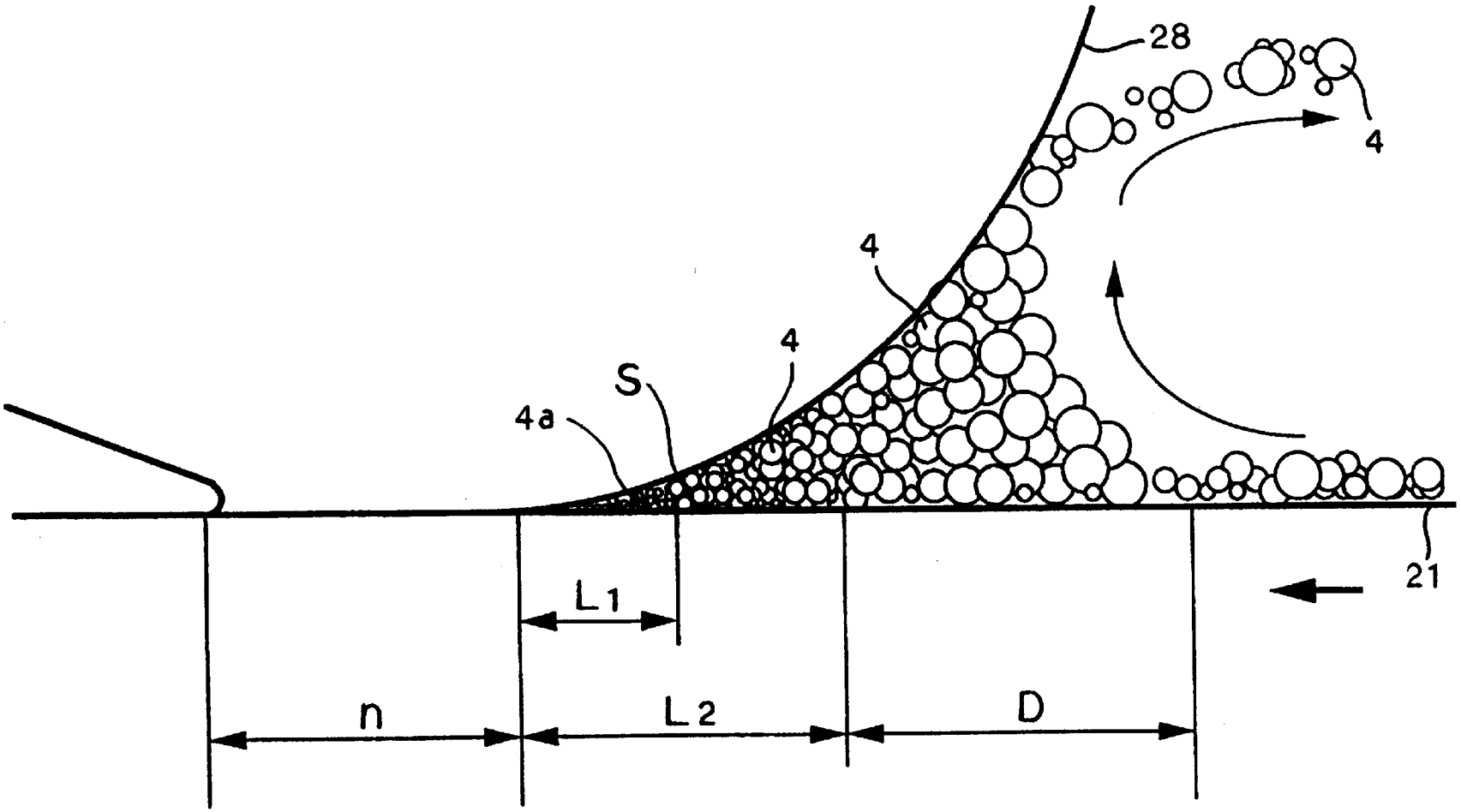
FIG. 6 is a schematic illustration showing a state where residues such as inorganic fine particles and toner particles stay in a staying portion on the upstream side of a portion where an end of a cleaning blade is in contact with the surface of an image carrier in the direction of rotation of the image carrier.

When the state where the toner particles or the like on the surface of the image carrier 21 are removed by the cleaning blade 28 is examined by the CCD camera 30, the end of the cleaning blade 28 is deformed by coming into contact with the surface of the moving image carrier 21, whereby a staying portion S in a wedge shape is formed on the upstream side of a portion where the end of the cleaning blade 28 is in contact with the surface of the image carrier 21 in the direction of rotation of the image carrier 21, as shown in FIG. 6.

The toner particles 4 and the inorganic fine particles 4*a* adhering on the toner particles 4 are gradually stored in the staying portion S, and the inorganic fine particles 4*a*having small particle diameters are first successively stored in the portion where the end of the cleaning blade 28 is in contact with the surface of the image carrier 21, while parts of the inorganic fine particles 4*a* thus stored slip off a nip portion n between the cleaning blade 28 and the image carrier 21, so that the inorganic fine particles 4*a* are maintained in the staying portion S in a state where they stay by a predetermined length ($L_1$). The toner particles 4 or the like having larger particle diameters than those of the inorganic fine particles 4*a* are stored to stay in the order of increasing particle diameters in the portion on the upstream side of the portion where the inorganic fine particles 4*a* stay in the direction of rotation of the image carrier 21. The inorganic fine particles 4*a* and the toner particles 4 or the like are maintained in the staying portion S in a state where they stay by a predetermined length ($L_2$). In this portion, the inorganic fine particles 4*a* and the toner particles 4 or the like hardly move and stand still.

Furthermore, in a portion on the upstream side of the portion where the inorganic fine particles 4*a* and the toner particles 4 or the like stay in the direction of rotation of the image carrier 21, a speed-reducing portion D where the toner particles 4 or the like carried as the image carrier 21 is rotated are gradually moved while being decelerated is formed, whereby the toner particles 4 or the like having large particle diameters carried as the image carrier 21 is rotated are removed from the image carrier 21 in the speed-reducing portion D. On the other hand, the toner particles 4 or the like having small particle diameters gradually proceed forward in the speed-reducing portion D. When the toner particles 4 or the like thus proceed forward, the toner particles 4 or the like having large particle diameters in the speed-reducing portion D are extruded and are removed from the surface of the image carrier 21.

When the toner particles 4 or the like reach a portion where the toner particles or the like having small particle diameters stay as mentioned above through the speed-reducing portion D, the toner particles 4 or the like having larger particle diameters than those of the toner particles 4 or the like staying in the staying portion cannot proceed any more, and are removed from the surface of the image carrier 21, while the toner particles 4 or the like having smaller particle diameters than those of the toner particles 4 or the like staying in the staying portion proceed while extruding the staying toner particles 4 or the like from the staying portion, whereby the extruded toner particles 4 or the like are removed from the surface of the image carrier 21.

The contact angle at which the cleaning blade 28 is pressed against the surface of the image carrier for examination 21 is then adjusted to 6°, 9° and 12°, and the contact pressure for pressing the end of the cleaning blade 28 against the surface of the image carrier 21 is adjusted to 2 g/mm, 3 g/mm and 4 g/mm, a state where the inorganic fine particles 4*a* and the toner particles 4 or the like are stayed in the staying portion S is examined, and the length ($L_1$) of the portion where the inorganic fine particles 4*a* stay and the length ($L_2$) of the entire portion where the inorganic fine particles 4*a* and the toner particles 4 or the like stay are measured. The results thereof are shown in the following Table 1:

TABLE 1

| contact angle | length of stay | contact pressure 2 g/mm | 3 g/mm | 4 g/mm |
|---|---|---|---|---|
| 6° | $L_1$ (μm) | 3 | 5 | 4 |
| | $L_2$ (μm) | 8 | 10 | 9 |
| 9° | $L_1$ (μm) | 5 | 10 | 8 |
| | $L_2$ (μm) | 11 | 20 | 15 |
| 12° | $L_1$ (μm) | 28 | 35 | 55 |
| | $L_2$ (μm) | 40 | 60 | 120 |

The cleaning capability in a case where the length ($L_1$) of the portion where the inorganic fine particles 4*a* stay and the length ($L_2$) of the entire portion where the inorganic fine particles 4*a* and the toner particles 4 or the like stay are adjusted as mentioned above to do cleaning is evaluated. The results thereof are shown in the following Table 2. In the Table 2, ◎ represents a case where cleaning is completely done and is very good, ○ represents a case where cleaning is almost done and is good, and X represents a case where cleaning is not completely done, and a case where the cleaning blade 28 is turned up and over as the image carrier 21 is moved is represented by "turned-up".

TABLE 2

| | | | | | | | | | |
|---|---|---|---|---|---|---|---|---|---|
| $L_1$ (μm) | 3 | 5 | 4 | 5 | 10 | 8 | 28 | 35 | 55 |
| $L_2$ (μm) | 8 | 10 | 9 | 11 | 20 | 15 | 40 | 60 | 120 |
| evaluation | x | ○ | x | ○ | ○ | ○ | ◎ | ◎ | turned-up |

A commercially available electrophotographic printer (Fine writer manufactured by Minolta Camera Co., Ltd.) is then modified, to set the fixing temperature in a fixing roller in the printer to 130° C., and a contact angle and contact pressure of a cleaning blade with an image carrier are set to the above-mentioned conditions under which the length ($L_1$) of the portion where the inorganic fine particles 4*a* stay is in the range of 5 to 50 μm and the length ($L_2$) of the entire portion where the inorganic fine particles 4*a* and the toner particles 4 or the like stay is in the range of 10 to 100 μm. The above-mentioned toner particles are supplied to a developing device in the printer, to form images. As a result, no noise such as noise caused by fine powder of the toner particles based on incomplete cleaning, or noise caused by film-forming an anti-offset material is produced in the formed images, and the cleaning blade is not deformed and turned up. Therefore, good images are stably obtained over a long time period, and the toner particles are sufficiently fixed on paper even by the above-mentioned fixing at low temperatures.

EXAMPLE 2

In this example, a two-component developing agent using toner particles and magnetic carriers is used as a developing agent.

In producing the toner particles, 60 parts by weight of styrene, 35 parts by weight of n-butyl methacrylate, 5 parts by weight of methacrylic acid, 0.5 parts by weight of 2, 2-azobis-(2, 4-dimethylvaleronitrile), 3 parts by weight of low-molecular weight polypropylene (Biscole 605P made by Sanyo Kasei K.K.), 8 parts by weight of carbon black (MA#8 made by Mitsubishi Chemical Industries, Ltd.), and 3 parts by weight of a zinc salicylate complex (E-84 made by Olient Kagaku K.K.) were mixed using a sand stirrer, to prepare a polymerizable composition.

The polymerizable composition was subjected to polymerization reaction at a temperature of 60° C. for six hours while being agitated in a 3 percent gum arabic solution at a rotating speed of 4500 rpm using an agitator (TK-Auto Homomixer manufactured by Tokusyu Kika Kogyo K.K.), to obtain spherical toner particles having an average particle diameter of 5 μm. The toner particles were repeatedly filtered and water-washed, after which the filtered toner particles was completely air-dried at a temperature of 35° C. and at a humidity of 30% RH, to obtain spherical toner particles having an average particle diameter of 5 μm.

0.3 parts by weight of hydrophobic silica having a BET specific surface area of 140 $m^2/g$ (H-2000 made by Hoechst Japan Ltd.) was added as inorganic fine particles to 100 parts by weight of the toner particles, and they were mixed and agitated using Henschel Mixer, to make the hydrophobic silica adhere to the toner particles.

In producing the carriers, 100 parts by weight of polyester resin (NE-1110 made by Kao K.K.), 600 parts by weight of inorganic magnetic powder (MFP-2 made by TDK Corporation), and 2 parts by weight of carbon black (MA#8 made by Mitsubishi Chemical Industries, Ltd.) were considerably mixed using Henschel Mixer, and a mixture obtained was ground, after which the ground mixture was then melted and kneaded using an extrusion kneader having a cylinder portion set to 180° C. and a cylinder head portion set to 170° C., and the kneaded mixture was cooled, was then granulated, and was further pulverized using a jet mill, followed by classification using an air classifier, to obtain binder type carriers having an average particle diameter of 55 μm.

The toner particles and the carriers were mixed with each other, to prepare a developing agent containing 5% by weight toner particles. The developing agent is supplied to the developing device 23 in the experiment device 20 shown in FIG. 5, as in the above-mentioned example 1, to conduct experiments. A state where the toner particles or the like on the surface of the image carrier 21 are removed using the cleaning blade 28 is photographed by the CCD camera 30 provided on the side of the inner periphery of the image carrier 21, to examine how residues such as the toner particles are removed from the surface of the image carrier 21.

As a result, in this example, the same results as those in the above-mentioned example 1 are also obtained, as shown in FIG. 6.

The contact angle at which the cleaning blade 28 is pressed against the surface of the image carrier for examination 21 is then adjusted to 14°, 16° and 20°, and the contact pressure for pressing the end of the cleaning blade 28 against the surface of the image carrier 21 is adjusted to 1.5 g/mm, 2.0 g/mm and 3.0 g/mm, a state where the inorganic fine particles 4*a* and the toner particles 4 or the like stay in the staying portion S is examined, and the length ($L_1$) of the portion where the inorganic fine particles 4*a* stay and the length ($L_2$) of the entire portion where the inorganic fine particles 4*a* and the toner particles 4 or the like stay are measured. The results thereof are shown in the following Table 3:

TABLE 3

| contact angle | length of stay | contact pressure 1.5 g/mm | 2.0 g/mm | 3.0 g/mm |
|---|---|---|---|---|
| 14° | $L_1$ (μm) | 0 | 2 | 5 |
| | $L_2$ (μm) | 3 | 5 | 8 |
| 16° | $L_1$ (μm) | 4 | 6 | 11 |
| | $L_2$ (μm) | 10 | 15 | 20 |
| 20° | $L_1$ (μm) | 18 | 30 | 40 |
| | $L_2$ (μm) | 30 | 50 | 110 |

The cleaning capability in a case where the length ($L_1$) of the portion where the inorganic fine particles 4*a* stay and the length ($L_2$) of the entire portion where the inorganic fine particles 4*a* and the toner particles 4 or the like stay are adjusted as mentioned above to do cleaning is evaluated. The results thereof are shown in the following Table 4. In the Table 4, ○ represents a case where cleaning is completely done and is very good, Δ represents a case where cleaning is almost done, causing no problem, and X represents a case where cleaning is not completely done, causing a problem, and a case where the cleaning blade 28 vibrates due to friction with the image carrier 21 to produce sound is represented by "sound".

TABLE 4

| | | | | | | | | | |
|---|---|---|---|---|---|---|---|---|---|
| $L_1$ (μm) | 0 | 2 | 5 | 4 | 6 | 11 | 18 | 30 | 40 |
| $L_2$ (μm) | 3 | 5 | 8 | 10 | 15 | 20 | 30 | 50 | 110 |
| evaluation | x | x | Δ | x | ○ | ○ | ○ | ○ | sound |

A commercially available electrophotographic copying machine (Di30 manufactured by Minolta Camera Co., Ltd.) is then modified, and a contact angle and contact pressure of a cleaning blade with an image carrier are set to the above-mentioned conditions under which the length ($L_1$) of the portion where the inorganic fine particles 4*a* stay is in the range of 5 to 50 μm and the length ($L_2$) of the entire portion where the inorganic fine particles 4*a* and the toner particles 4 or the like stay is in the range of 10 to 100 μm. The above-mentioned developing agent is supplied to a developing device in the electrophotographic copying machine, to form images. As a result, no noise such as image noise caused by incomplete cleaning is produced in the formed images. The cleaning blade does not vibrate to produce sound or is not turned up due to friction with the image carrier. Therefore, precise and good images are stably obtained over a long time period.

EXAMPLE 3

In this example, in obtaining toner particles used for a developing agent, binder resin is produced in the following manner.

A reflux condenser, a water separator, a nitrogen gas inlet tube, a thermometer, and an agitator were first mounted on a 5 liter four neck flask, and the four neck flask was located in a mantle heater. 1376 g of a bisphenol propylene oxide additive and 472 g of isophthalic acid were added in the flask so that COOH/OH becomes 1.4, followed by dehydrogenation condensation at a temperature of 240° C. while introducing nitrogen into the flask, to obtain low-molecular weight polyester resin having a weight-average molecular weight (Mw) of 5000 and having a glass transition point (Tg) of 61° C.

On the other hand, 1720 g of a bisphenol propylene oxide additive, 860 g of isophthalic acid, 119 g of succinic acid, 129 g of diethylene glycol, and 74.6 g of glycerin were added so that OH/COOH becomes 1.2 in a 5 liter four neck flask located in the mantle heater, in the same manner as that in the case of low-molecular weight polyester, followed by dehydrogenation condensation at a temperature of 240° C. while introducing nitrogen into the flask, to obtain polyester resin to be made high-molecular having a weight-average molecular weight (Mw) of 7000 and having a glass transition point (Tg) of 42° C.

4200 parts by weight of the low-molecular weight polyester resin and 2800 parts by weight of the polyester resin to be made high-molecular were dryblended using Henschel Mixer until they become sufficiently uniform, after which a mixture obtained was put into a heating kneader. 100 parts by weight of diphenylmethane-4, 4-diisocyanate was added to the mixture so that NCO/OH becomes 1.0 under the conditions of 120° C., and they were reacted with each other four one hour, to confirm by measuring NCO % that there are few liberated isocyanate groups left. Thereafter, a mixture obtained by the reaction was cooled, to obtain polyester resin having a urethane bond. The content of a solvent (methyl ethyl ketone) insoluble component, the glass transition point (Tg), the softening point (Tm), and the acid value of the polyester resin thus obtained are respectively 20% by weight, 65° C., 140° C., and 25 KOH mg/g.

100 parts by weight of the polyester resin, 6 parts by weight of carbon black (Raven 1255 made by Colombian Carbon K.K.), 2 parts by weight of a negative charge-controlling agent (Bontron S-34 made by Orient Kagaku Kogyo K.K.), and 3 parts by weight of low-molecular weight polypropylene having acid groups (Biscole TS-200 made by Sanyo Kasei K.K.) were considerably mixed using Henschel Mixer, after which a mixture obtained was then melted and kneaded using a biaxial extrusion kneader, and the kneaded mixture was left as it is and cooled, was then granulated using a feather mill, and was further pulverized using a jet mill, followed by air classification, to obtain toner particles having a volume-mean particle size of 8.0 μm.

0.5 parts by weight of hydrophobic silica having a BET specific surface area of 140 $m^2/g$ (H-2000 made by Hoechst Japan Ltd.) was added as inorganic fine particles to the toner particles thus obtained, and they were mixed using Henschel Mixer, to make the inorganic fine particles adhere to the toner particles.

The toner particles obtained in the above-mentioned manner are supplied to the developing device 23 in the experiment device 20 shown in FIG. 5, to conduct experiments, as in the above-mentioned examples 1 and 2.

In this example, examples of the image carrier for examination 21 include an image carrier obtained by dip coating the surface of a cylindrical glass tube having a diameter of 30 mm with a coating fluid for a charge-transporting layer obtained by dissolving 50 parts by weight of a diamino compound indicated by the following chemical formula 1, 50 parts by weight of bisphenol Z-type polycarbonate resin (Upiron Z made by Mitsubishi Gas Chemical Company, Inc.), 1.5 parts by weight of a cyano compound indicated by the following chemical formula 2, and 4 parts by weight of di-tert-butyl-hydroxytoluene in dichloromethane so that the dry film thickness becomes 30 μm, followed by drying, to provide a transparent charge-transporting layer on the surface of the glass tube. The charge mobility in the charge-transporting layer is $4\times10^{-5}$ $cm^2/V\cdot sec$ under the conditions of $2\times10^5$ V/cm.

[Chemical formula 1]

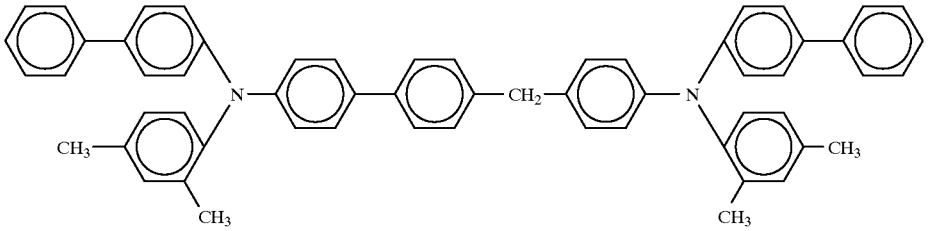

[Chemical formula 2]

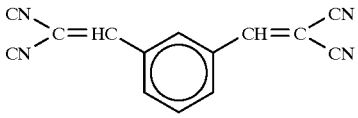

The image carrier for examination 21 is so rotated that the moving speed thereof in the tangential direction becomes 300 mm/sec, to charge the surface of the image carrier 21 by the charger 22, after which the toner particles are supplied to the surface of the image carrier 21 from the developing device 23, the end of the cleaning blade 28 is caused to abut against the surface of the image carrier 21 to which the toner particles are supplied, and the toner particles on the surface of the image carrier 21 are removed by the cleaning blade 28, after which a potential remaining on the image carrier 1 is discharged by the discharger 29.

Examples of the above-mentioned cleaning blade 28 include a cleaning blade composed of the same polyurethane rubber (made by Hokushin Rubber K.K.) as that in the above-mentioned examples 1 and 2. In pressing the cleaning blade 28 against the surface of the image carrier 21, a contact angle θ is adjusted while being measured by the angle measuring device 28*a*, and contact pressure for pressing the end of the cleaning blade 28 against the surface of the image carrier 21 is adjusted by the spring 28*b*, as in the above-mentioned examples 1 and 2.

A state where the toner particles or the like on the surface of the image carrier 21 are removed by the cleaning blade 28 as mentioned above is photographed by the CCD camera 30 provided on the side of the inner periphery of the image carrier 21, to examine how residues such as the toner particles are removed from the surface of the image carrier 21.

As a result, in this example, the same results as those in the above-mentioned examples 1 and 2 are also obtained, as shown in FIG. 6.

The contact angle at which the cleaning blade 28 is pressed against the surface of the image carrier for examination 21 is adjusted to 6°, 9°, 12° and 15°, and the contact pressure for pressing the end of the cleaning blade 28 against the surface of the image carrier for examination 21 is adjusted to 1.5 g/mm, 2.0 g/mm and 3.0 g/mm, a state where the inorganic fine particles 4*a* and the toner particles 4 or the like are stayed in the staying portion S is examined, and the length ($L_1$) of the portion where the inorganic fine particles 4*a* stay and the length ($L_2$) of the entire portion where the inorganic fine particles 4*a* and the toner particles 4 or the like stay are measured. The results thereof are shown in the following Table 5:

TABLE 5

| contact angle | length of stay | contact pressure 1.5 g/mm | 2.0 g/mm | 3.0 g/mm |
|---|---|---|---|---|
| 6° | $L_1$ (μm) | 3 | 3 | 5 |
| | $L_2$ (μm) | 9 | 8 | 9 |
| 9° | $L_1$ (μm) | 4 | 8 | 13 |
| | $L_2$ (μm) | 16 | 15 | 25 |
| 12° | $L_1$ (μm) | 16 | 20 | 28 |
| | $L_2$ (μm) | 38 | 45 | 65 |
| 15° | $L_1$ (μm) | 21 | 37 | 58 |
| | $L_2$ (μm) | 52 | 72 | 108 |

The cleaning capability in a case where the length ($L_1$) of the portion where the inorganic fine particles 4*a* stay and the length ($L_2$) of the entire portion where the inorganic fine particles 4*a* and the toner particles 4 or the like stay are adjusted as mentioned above to do cleaning is evaluated. The results thereof are shown in the following Table 6. In the Table 6, ○ represents a case where cleaning is completely done and is good, Δ represents a case where cleaning is almost done, and X represents a case where cleaning is not completely done, and a case where the cleaning blade 28 is turned up and over as the image carrier 21 is moved is represented by "turned-up".

TABLE 6

| | | | | | | | | | |
|---|---|---|---|---|---|---|---|---|---|
| $L_1$ (μm) | 3 | 3 | 5 | 4 | 8 | 13 | 16 | 20 | 28 |
| $L_2$ (μm) | 9 | 8 | 9 | 16 | 15 | 25 | 38 | 45 | 65 |
| evaluation | x | x | Δ | x | ○ | ○ | ○ | ○ | ○ |
| $L_1$ (μm) | 21 | 37 | | 58 | | | | | |
| $L_2$ (μm) | 52 | 72 | | 108 | | | | | |
| evaluation | ○ | ○ | | turned-up | | | | | |

In examining the cleaning capability in a case where images are formed by the actual image forming apparatus, an image carrier produced in the following manner is used.

In producing the image carrier, 1 part by weight of an azo pigment indicated by the following chemical formula 3, 1 part by weight of polyester resin (Bylon 200 made by Toyobo Co., Ltd.), and 500 parts by weight of cyclohexanone were dispersed using a sand mill, and were then diluted with 500 parts by weight of tetrahydrofuran, to prepare a coating fluid for a charge-generating layer. The coating fluid for a charge-generating layer was so applied to an aluminum drum having a diameter of 30 mm that the dry film thickness becomes approximately 0.3 μm, followed by drying, to form a charge-generating layer on the aluminum drum, after which a charge-transporting layer having a thickness of 30 μm was provided on the charge-generating layer, in the same manner as that in producing the above-mentioned image carrier for examination 21, to obtain a functional separation type image carrier in which the charge-generating layer and the charge-transporting layer are laminated.

[Chemical Formula 3]

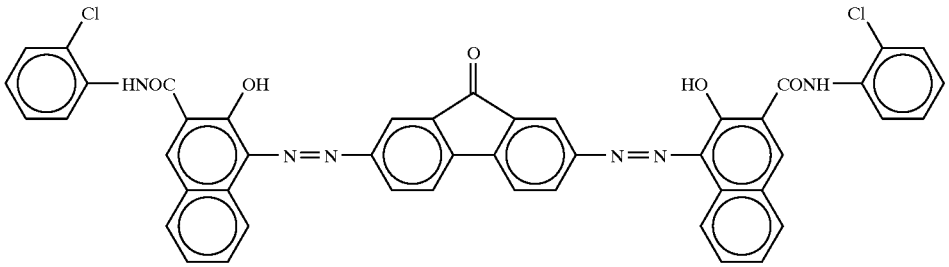

A commercially available electrophotographic printer (Fine writer 601 manufactured by Minolta Camera Co., Ltd.) is modified, to set the system speed thereof to 300 mm/sec. An image carrier produced in the above-mentioned manner is carried on the modified printer, the cleaning blade 28 used in the above-mentioned experiment device 30 is used as a cleaning blade to be pressed against the image carrier, and a contact angle and contact pressure of the cleaning blade with the image carrier are set to the above-mentioned conditions under which the length ($L_1$) of the portion where the inorganic fine particles 4*a* stay is in the range of 5 to 50 μm and the length ($L_2$) of the entire portion where the inorganic fine particles 4*a* and the toner particles 4 or the like stay is in the range of 10 to 100 μm. The above-mentioned toner particles are supplied to a developing device in the printer, to form images.

As a result, no fog, noise or the like due to incomplete cleaning, for example, is produced in the formed images. The cleaning blade does not vibrate to produce sound or is not turned up due to friction with the rotating image carrier. Therefore, precise and good images are stably obtained over a long time period.

EXAMPLE 4

In this example, a two-component developing agent using toner particles and magnetic carriers is used as a developing agent.

As the toner particles in the developing agent, toner particles produced in the following manner are used.

As binder resin used for the toner particles, two types of polyester resin A and B produced in the following manner are used.

In producing the polyester resin A, a reflux condenser, a water separator, a nitrogen gas inlet tube, a thermometer, and an agitator were mounted on a 2 liter four neck flask, and the four neck flask was located in a mantle heater. 735 g of polyoxypropylene (2. 2)-2, 2-bis (4 -hydroxyphenyl) propane, 292.5 g of polyoxyetylene (2. 0)-2, 2-bis (4-hydroxyphenyl) propane, 448.2 g of terephthalic acid, and 22 g of trimellitic acid were added in the four neck flask, and they were agitated while introducing nitrogen into the flask, and were reacted with each other at a temperature of 220° C. The progress of the reaction was traced while measuring the acid value, and the reaction was terminated at the time point where the acid value reaches a predetermined value, to obtain polyester resin A having a softening point of 108.3° C.

Polyester resin B having a softening point of 152.5° C. was produced, similarly to the above-mentioned polyester resin A except that 735 g of polyoxypropylene (2. 2)-2, 2 -bis (4-hydroxyphenyl) propane, 292.5 g of polyoxyetylene (2. 0)-2, 2-bis (4-hydroxyphenyl) propane, 249 g of terephthalic acid, 177 g of succinic acid, and 22 g of trimellitic acid were added in the four neck flask.

65 parts by weight of the polyester resin A, 35 parts by weight of the polyester resin B, 3 parts by weight of polypropylene having acid groups (Biscole TS-200 made by Sanyo Kasei K.K.), 5 parts by weight of a negative charge-controlling agent (Bontron S-34 made by Olient Kagaku Kogyo K.K.), and 8 parts by weight of carbon black (Mogal L made by Cabot K.K.) were considerably mixed using Henschel Mixer, after which a mixture obtained was melted and kneaded using a biaxial extrusion kneader, and the kneaded mixture was cooled, was then granulated using a hammer mill, and was further pulverized using a jet mill, followed by classification using a classifier (100/4ATP manufactured by Hosokawa Mikuron K.K.), to obtain toner particles having a volume-mean particle size of 8 μm.

0.4% by weight of hydrophobic silica fine powder having a BET specific surface area of 140 $m^2/g$ (H-2000 made by Hoechst Japan Ltd.) and 0.2% by weight of conductive titanium oxide having a BET specific surface area of 46 $m^2/g$ (EC300 made by Titanium Kogyo K.K.) were added as inorganic fine particles in the toner particles, and they were mixed with each other, to make the inorganic fine particles adhere to the toner particles.

On the other hand, as the magnetic carriers in the developing agent, binder type carriers produced in the following manner are used.

100 parts by weight of polyester resin having a number-average molecular weight (Mn) of 5000, having a weight-average molecular weight (Mw) of 115000, having a glass transition temperature (Tg) of 67° C., and having a softening point (Tm) of 123° C., and 50 parts by weight of ferrite fine particles (MFP-2 made by TDK Corporation) were considerably mixed using Henschel Mixer, after which a mixture obtained was melted and kneaded using a biaxial extrusion kneader, and the kneaded mixture was cooled, was then granulated, and was further pulverized using a jet mill, followed by classification using an air classifier, to obtain carrier particles having an average particle diameter of 20

μm. The carrier particles were heated and made spherical at a temperature of 300° C. using Surfusing System (Nippon Pnewmatic Kogyo K.K.), to obtain binder type carriers.

The toner particles and the carriers were mixed with each other, to prepare a developing agent containing 7% by weight toner particles. The developing agent was supplied to the developing device 23 in the experiment device 20 shown in FIG. 5, as in the above-mentioned examples 1 and 2, to conduct experiments. A state where the toner particles or the like on the surface of the image carrier 21 are removed by the cleaning blade 28 is photographed using the CCD camera 30 provided on the side of the inner periphery of the image carrier 21, to examine how residues such as the toner particles are removed from the surface of the image carrier 21.

As a result, in this example, the same results as those in the above-mentioned examples 1 to 3 are also obtained, as shown in FIG. 6.

The contact angle at which the cleaning blade 28 is then pressed against the surface of the image carrier for examination 21 is adjusted to 14°, 16°, 18° and 20°, and the contact pressure for pressing the end of the cleaning blade 28 against the surface of the image carrier 21 is adjusted to 1.5 g/mm, 2.0 g/mm and 3.0 g/mm, a state where the inorganic fine particles 4*a* and the toner particles 4 or the like are stayed in the staying portion S is examined, and the length ($L_1$) of the portion where the inorganic fine particles 4*a* stay and the length ($L_2$) of the entire portion where the inorganic fine particles 4*a* and the toner particles 4 or the like stay are measured. The results thereof are shown in the following Table 7:

TABLE 7

| contact angle | length of stay | contact pressure 1.5 g/mm | 2.0 g/mm | 3.0 g/mm |
|---|---|---|---|---|
| 14° | $L_1$ (μm) | 3 | 3 | 3 |
| | $L_2$ (μm) | 3 | 5 | 5 |
| 16° | $L_1$ (μm) | 5 | 6 | 10 |
| | $L_2$ (μm) | 8 | 15 | 20 |
| 18° | $L_1$ (μm) | 8 | 10 | 26 |
| | $L_2$ (μm) | 30 | 38 | 59 |
| 20° | $L_1$ (μm) | 15 | 28 | 57 |
| | $L_2$ (μm) | 50 | 73 | 104 |

A commercially available electrophotographic copying machine (Di30 manufactured by Minolta Camera Co., Ltd.) is then modified, the above-mentioned cleaning blade is pressed against an image carrier in the copying machine, and a contact angle θ and contact pressure for pressing the cleaning blade against the image carrier are set as mentioned above so that the length ($L_1$) of the portion where the inorganic fine particles 4*a* stay and the length ($L_2$) of the portion where the inorganic fine particles 4*a* and the toner particles 4 or the like stay satisfy the conditions as indicated by the foregoing Table 1.

The above-mentioned developing agent is supplied to a developing device in the electrophotographic copying machine, to form 5000 images, and the cleaning capability under the conditions is evaluated. The results thereof are shown in the following table 8. As evaluation of the cleaning capability in the Table 8, X represents a case where noise such as a black spot is produced in the formed images, Δ represents a case where noise is slightly produced in the formed images, causing no problem, and ○ represents a case where no noise such as a black spot is produced in the formed images, to obtain good images, and a case where the cleaning blade is turned up due to friction with the image carrier is represented by "turned-up".

TABLE 8

| | | | | | | | | | |
|---|---|---|---|---|---|---|---|---|---|
| $L_1$ (μm) | 3 | 3 | 3 | 5 | 6 | 10 | 8 | 10 | 26 |
| $L_2$ (μm) | 3 | 5 | 5 | 8 | 15 | 20 | 30 | 38 | 59 |
| evaluation | x | x | x | Δ | ○ | ○ | ○ | ○ | ○ |
| $L_1$ (μm) | 15 | 28 | | 57 | | | | | |
| $L_2$ (μm) | 50 | 73 | | 104 | | | | | |
| evaluation | ○ | ○ | | turned-up | | | | | |

As a result, in a case where images are formed by setting the conditions under which the length ($L_1$) of the portion where the inorganic fine particles 4*a* stay is in the range of 5 to 50 μm, noise such as image noise due to incomplete cleaning is hardly produced in the formed images, the cleaning blade does not vibrate to produce sound or is not turned up due to friction with the image carrier. Further, in a case where the conditions under which the length ($L_2$) of the entire portion where the inorganic fine particles 4*a* and the toner particles 4 or the like stay is in the range of 10 to 100 μm are set, no noise such as a black spot is produced in the formed images. Therefore, precise and good images are stably obtained over a long time period.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In an image forming method in which an electrostatic latent image is formed on a rotating image carrier, the electrostatic latent image is developed by toner particles, to form a toner image on the surface of the image carrier, the toner image is transferred to a recording medium, and toner particles remaining on the surface of the image carrier are removed by a cleaning blade, wherein inorganic fine particles having a BET specific surface area from 30 to 300 $m^2/g$ stay in a portion on the upstream side of a portion where the cleaning blade is in contact with the surface of the image carrier in the direction of rotation of the image carrier, and the length of the portion where said inorganic fine particles stay on the upstream side of said contact portion in the direction of rotation of the image carrier is in the range of 5 to 50 μm.

2. The image forming method according to claim 1, wherein the distance between the contact portion and the portion where the inorganic fine particles stay is in the range of 15 to 30 μm.

3. The image forming method according to claim 1, wherein the residual toner particles stay from the contact point to the portion where the inorganic fine particles stay, and the distance between the contact portion and the portion where the inorganic fine particles stay is in the range of 10 to 100 μm.

4. The image forming method according to claim 1, wherein the inorganic fine particles comprise a first group having a BET specific surface area from 30 to 80 $m^2/g$ and a second group having a BET specific surface area from 80 to 300 $m^2/g$.

5. The image forming method according to claim 4, wherein the inorganic fine particles comprise a first group having a BET specific surface area from 30 to 60 $m^2/g$ and a second group having a BET specific surface area from 100 to 300 $m^2/g$.

6. The image forming method according to claim 1, wherein the toner particles comprise colored resin fine particles and inorganic fine particles having a BET specific surface area from 30 to 300 $m^2/g$ and adhering on the surface of the colored resin fine particles.

7. The image forming method according to claim 6, wherein the toner particles further comprise resin fine particles adhering on the surface of the colored resin fine particles.

8. The image forming method according to claim 7, wherein the amount of the inorganic fine particles adhering on the surface of the colored resin fine particles is in the range of 0.05 to 3.0 weight %, and the inorganic fine particles are treated by a hydrophobic group.

9. The image forming method according to claim 8, wherein the colored resin fine particles comprise binder resin, a colorant dispersed in the binder resin, a first anti-offset material, and a second anti-offset material having a different softening temperature from that of the first anti-offset material, and the toner particles have a volume-mean particle size from 4 to 9 $\mu$m.

10. The image forming method according to claim 9, wherein the binder resin has a softening temperature from 80 to 140° C., the first anti-offset material has a softening temperature from 60 to 110° C., and the second anti-offset material has a softening temperature from 110 to 150° C.

11. The image forming method according to claim 8, wherein the colored resin fine particles have a volume-mean particle size from 3 to 9 $\mu$m and are prepared by a wet process.

12. The image forming method according to claim 11, wherein the colored resin fine particles comprise binder resin, a colorant dispersed in the binder resin, and 1 to 15 parts by weight of the anti-offset material per 100 parts by weight of the binder resin.

13. The image forming method according to claim 8, wherein the toner particles have a volume-mean particle size from 4 to 9 $\mu$m, and are blended with magnetic carrier particles having a volume-mean particle size from 10 to 40 $\mu$m.

14. The image forming method according to claim 13, wherein magnetic carrier particles comprise binder resin and magnetic powder dispersed in the binder resin and having a volume-mean particle size of 5 $\mu$m or less.

15. In an image forming method in which an electrostatic latent image is formed on a cylindrical image carrier having a diameter from 20 to 40 mm and rotating at a tangent speed from 200 to 500 mm/sec, the electrostatic latent image is developed by toner particles having a volume-mean particle size from 4 to 9 $\mu$m, to form a toner image on the surface of the image carrier, the toner image is transferred to a recording medium, and toner particles remaining on the surface of the image carrier are removed by a cleaning blade, wherein inorganic fine particles having a BET specific surface area from 30 to 300 $m_2/g$ stay in a portion on the upstream side of a portion where the cleaning blade is in contact with the surface of the image carrier in the direction of rotation of the image carrier, and the length of the portion where said inorganic fine particles stay on the upstream side of said contact portion in the direction of rotation of the image carrier is in the range of 5 to 50 $\mu$m.

16. The image forming method according to claim 15, wherein the cylindrical image carrier has an amorphous photoconductive layer.

17. The image forming method according to claim 15, wherein the cylindrical image carrier has an organic photoconductive layer.

18. The image forming method according to claim 15, wherein the toner particles comprise colored resin fine particles and inorganic fine particles having a BET specific surface area from 30 to 300 $m^2/g$ and adhering on the surface of the colored resin fine particles.

19. The image forming method according to claim 18, wherein the toner particles further comprise resin particles adhering on the surface of the colored resin fine particles.

20. The image forming method according to claim 18, wherein the amount of the inorganic fine particles adhering on the surface of the colored resin fine particles is in the range of 0.05 to 3.0% by weight, and the inorganic fine particles are treated by a hydrophobic group.

* * * * *